US007677762B1

(12) United States Patent
Farhood, Jr. et al.

(10) Patent No.: US 7,677,762 B1
(45) Date of Patent: Mar. 16, 2010

(54) LIGHTING ARRAY AND CLIENT ATTRACTION DEVICE

(75) Inventors: Emile H. Farhood, Jr., Houston, TX (US); Joanne Page, Bellaire, TX (US)

(73) Assignee: Always in Season Decorating Services, Inc., Houston, TX (US)

( * ) Notice: Subject to any disclaimer, the term of this patent is extended or adjusted under 35 U.S.C. 154(b) by 0 days.

(21) Appl. No.: 12/259,805

(22) Filed: Oct. 28, 2008

(51) Int. Cl.
*F21V 33/00* (2006.01)

(52) U.S. Cl. ..... 362/249.01; 362/249.06; 362/249.11; 362/217.16; 362/382; 40/541; 40/564

(58) Field of Classification Search ..... 362/812, 362/249.01, 249.08, 249.11, 249.14, 249.16, 362/217.15–215.17, 418, 382, 249.06; 40/480, 40/502, 541, 564, 575, 576, 573
See application file for complete search history.

(56) References Cited

U.S. PATENT DOCUMENTS

| | | | | |
|---|---|---|---|---|
| 5,205,638 | A * | 4/1993 | Squitieri | 362/125 |
| 5,213,409 | A * | 5/1993 | Fisher | 362/249.14 |
| 5,808,592 | A * | 9/1998 | Mizutani et al. | 345/83 |
| 6,065,854 | A * | 5/2000 | West et al. | 362/249.06 |
| 6,400,279 | B1 * | 6/2002 | Tang | 340/815.4 |
| 6,964,366 | B2 * | 11/2005 | Peng et al. | 232/38 |
| 2006/0087843 | A1 * | 4/2006 | Setomoto et al. | 362/249 |

* cited by examiner

*Primary Examiner*—Laura Tso
(74) *Attorney, Agent, or Firm*—Buskop Law Group, PC; Wendy Buskop

(57) ABSTRACT

A lighting array comprising a grid to be formed into multiple positions with at least two cells, at least one interconnected wall between each pair of cells, and an opening in each cell. The lighting array further comprises at least a first holding arm secured to each cell, a second holding arm secured to each cell opposite the first holding arm, a rigid housing removably insertable into each cell, at least one light supported within each rigid housing and a power supply connected to each light.

22 Claims, 8 Drawing Sheets

LIGHTING ARRAY AND CLIENT ATTRACTION DEVICE

FIELD

The present embodiments relate to a lighting array comprising a grid to be formed into multiple positions with at least two cells, at least one interconnected wall between each pair of cells, and an opening in each cell. The lighting array further comprises at least a first holding arm secured to each cell, a second holding arm secured to each cell opposite the first holding arm, a rigid housing removably insertable into each cell, at least one light supported within each rigid housing and a power supply connected to each light source.

The present embodiments provide a lightweight, re-formable, reusable, and environmentally friendly interchangeable grid for use with large lighting presentations on buildings, housing and other large or small structures.

BACKGROUND

Current lighting arrays require the mounting of lights on a fixed, rigid structure to form a rigid light array structure. This prior art arrangement does not allow for easy removal of the lighting array from an attached structure. This prior art arrangement also does not allow for easy transport of the lighting array due to the array being a one-piece rigid structure. One-piece rigid structures can present problems in moving because the structure cannot collapse, bend, or break down into component parts to allow for ease in mobility. A need exists for a malleable light array that can form a desired signage, while maintaining a rigid enough structure to support the lights and other signage. Also, current lighting arrays are designed for specific lighting uses and are not adaptable for other additional uses. A need also exists for a light array that is interchangeable and recyclable and that can be used and adapted for different uses.

Many of the current lighting arrays are also require custom fabrication. Custom fabrication requires extra manpower, and thus, higher costs. A further need exists for a lighting array that requires fewer steps in manufacturing, thereby lowering the cost of labor to make the device.

The present embodiments meet these needs.

BRIEF DESCRIPTION OF THE DRAWINGS

The detailed description will be better understood in conjunction with the accompanying drawings as follows.

Figure 1:
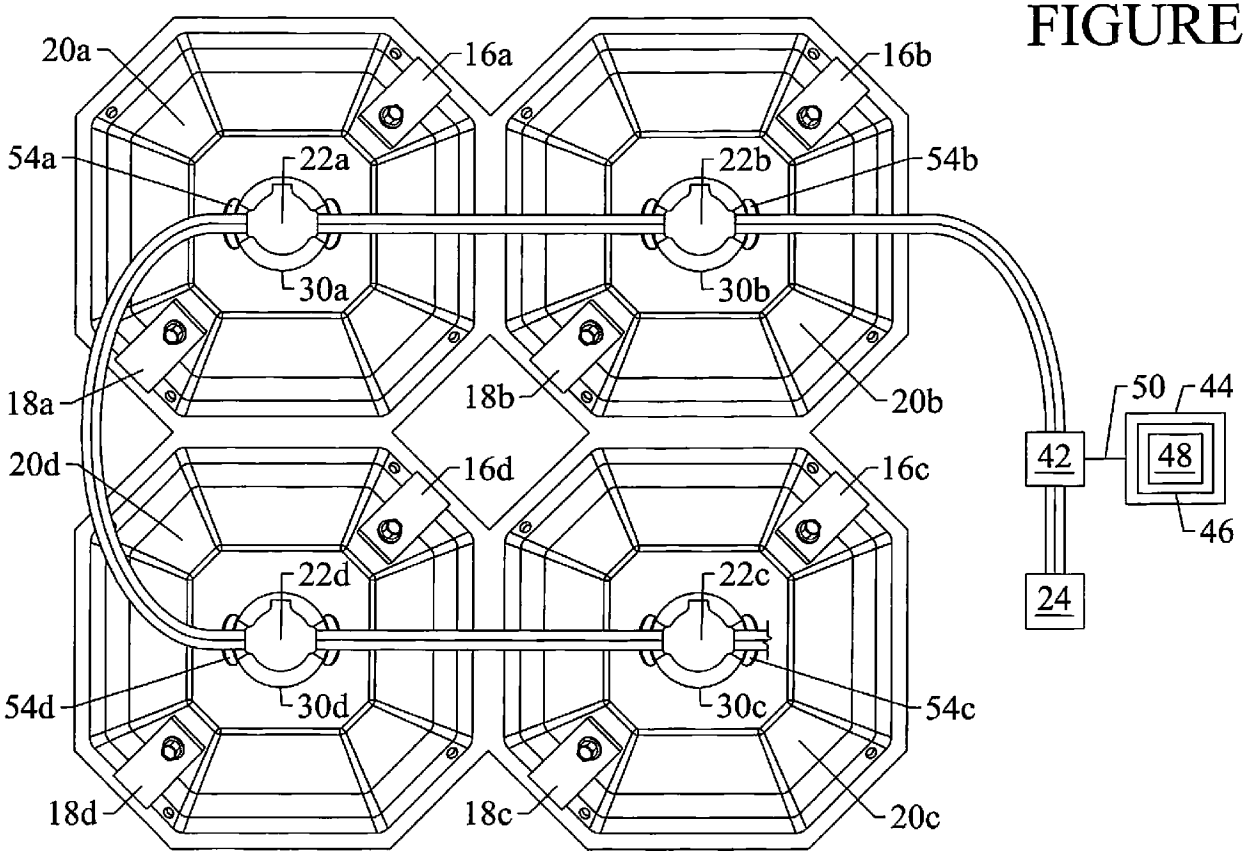
FIG. 1 depicts a bottom, or back, view of the lighting array according to the embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a lighting array that can comprise a grid, that can be formed into multiple positions, with at least two cells, at least one interconnected wall between each pair of cells, and an opening in each cell. The lighting array can further comprise at least a first holding arm secured to each cell, a second holding arm secured to each cell opposite the first holding arm, a rigid housing removably insertable into each cell, at least one light supported within each rigid housing and a power supply connected to each light.

The present embodiments can provide a lightweight, re-formable, reusable, and environmentally friendly interchangeable grid for use with large and small lighting presentations on buildings, housing and other structures.

The term "recyclable" as used herein can refer to the consumer's ability to reuse the lighting array year to year. The term "recyclable" also refers to the ability to melt down and reuse the materials in another end use, or simply in another lighting array, as an environmentally friendly device.

The term "malleable" as used herein can refer to the grid having an ability to be extended or shaped by hammers or rollers.

The lighting array can use light emitting diodes (LED), incandescent bulbs, fluorescent bulbs, halogen lights, chase lights, twinkling lights, or combinations thereof. The bulbs can be C-7, C-9, G-40, mini sized light bulbs or other types.

The grid creating the lighting array can be as small as about 6 inches by about 6 inches and range as large as possible, such for a 6-story building, or even larger. It is contemplated that the grid can be an entire city block long, or even longer. The light array can be "super sized" by interconnecting many grids of the lighting array together.

Each cell on the grid can have a shape, such as octagonal shape, pentagonal shape, oval, elliptical, rectangular, square, or an additional geometrical shape.

The grid can be about 0.025 inches in thickness. It is contemplated that the grid can be thinner, such as about 0.015 inches in thickness and fatter, such as about 0.5 inches in thickness. The thinness, as a feature, can add to the flexibility of the overall grid and can make it more manageable for installation. The thinness can also enable the grid to be bended into many shapes, as it is not completely rigid and immovable, while remaining rigid enough to support lights, housings, signage or other printed media.

In an embodiment, the grid can be flexible enough to have the shape of an object such as a Christmas tree, an ornament, a Santa Claus, a reindeer, a sleigh, a candy cane, an elf, a gift box, a star, a snowflake, a train, a caboose, a train car, a race car, a flower, or an additional shape.

The lighting array can have one small cell with a dimension of about 1 inch long by about 1 inch high, or a large cell that can be about 48 inches long by about 48 inches in height.

The grid can have as few as two cells connected together or as many as several thousand or even more, depending on if the grid is used to light a large bridge or other amazingly huge surface, such as the Golden Gate Bridge or the Brooklyn Bridge.

The interconnected wall between each cell can be about 1 inch in width, but can be as small as about 0.25 inches or as large as about 60 inches.

In an embodiment, the grid can be laser cut out of metal.

In an embodiment, each cell can have an opening that is slightly smaller than a housing depending on the pitch of the sides of the housing to be inserted in the opening.

In another embodiment, each cell can have an opening that is larger than a housing to be positioned in the cell, and the first and/or second arms can hold in this smaller housing, and space around the smaller housing can allow wind to pass through the housing and keep the display secure, either free standing or attached to a facility.

In an embodiment, the display can be secured, either free standing or attached to a facility in an exterior environment. While, in another embodiment, the display can be secured, either free standing or attached to a facility in an interior environment.

Alternatively, between groups of about four cells, or groups of about two cells, wind holes having diameters of about 1 inch to several inches can be formed to keep the display secure, either free standing or attached to a facility in any environment.

In an embodiment, the wind holes can be slits, which can be less than about 1 inch in width and about 1 inch long.

The wind holes and slits can be formed to create a message with the grid.

The holding arms can be between about 2 inches long and about 0.50 inches wide. The holding arms can be formed by cutting out, such as with a laser, each individual cell creating the grid, and during cutting leaving enough material to form the pair of holding arms. The holding arms can be larger or shorter for larger or smaller cell sizes and housing sizes.

In an embodiment, it can be contemplated that the same material can be used for forming the grid and the holding arms. This can help the display to be more resistant to breakage, as no welds or fasteners are needed to attach holding arms. The holding arms can actually be formed as the grid is formed, making a display and light array that requires fewer steps in the manufacturing, lowering the cost of labor to make the device.

The rigid housing, as the term is used herein refers to an embodiment that can be a plastic "jewel" shaped cover. A jewel shaped cover can look like a diamond, a ruby, an emerald or any other precious stone. Each jewel shaped cover can have a jewel cut, such as marquis cut, an emerald cut, a square cut, a pillow cut, a round cut, a pear cut, a baguette, a princess cut, or similar cuts used in creating diamonds or other precious stone jewelry. Additional shapes can be used such as polygon.

In an embodiment, the plastic jewel cover thickness can range between about 0.015 inch to about 1 inch, and can be made from plastic, such as polypropylene plastic that can be colored, provided with a mirror backing, made to glisten, or have opacity.

In an embodiment, the mirror backing can be located in the housing, which can further provide reflection or day time effects without the need of internal lighting.

Besides a jewel shape, the rigid housing can be ball shaped or elliptical. The rigid housing in an embodiment can be very stiff, and not bend, enabling the cells to bend around the rigid housing.

As used herein the term "removable inserted" when referring to the rigid housing can mean that the rigid housing can be inserted into the cell, and secured there by the first and second holding arms, and then taken out for another effect or for maintenance, or for changing a message that is created using a plurality of the cells.

For example, in an embodiment, a group of red housings can create a written message and can be surrounded by blue housings, the red housings can be removed and replaced with green to create different words.

The light can be supported within the rigid housing. In embodiment, the light can be supported in each housing with a lightweight clip that can attach using a bendable, thin metal that can attach to the housing.

One large light, or possible groups of small lights can be inserted into the rigid housing and attached with the lightweight clip or other fasteners in an embodiment of the invention.

The power supply usable herein can be 120 volt, 220 volt, 110 volt, 12 volt DC. The power supply can be a fuel cell, a wind tower, another renewable power source, or conventional grid electricity.

The lights of the lighting array can be clear, colored or a mixture thereof.

FIG. 1 depicts a bottom, or back, view of the lighting array according to the embodiments. The array can be adapted to form into multiple positions comprising at least a first holding arm (16*a*, 16*b*, 16*c*, 16*d*) secured to each cell. A second holding arm (18*a*, 18*b*, 18*c*, 18*d*) can be secured to each cell opposite the first holding arm.

A rigid housing (20*a*, 20*b*, 20*c*, 20*d*) can be removably, or unremovably, insertable into each cell. The rigid housing can have a "jewel" shape, a ball shape, an elliptical shape or any other polygon shape.

At least one light (22*a*, 22*b*, 22*c*, 22*d*) can be supported, or non-supported, within each rigid housing. Each light can be affixed, by use of a light weight clip (54*a*, 54*b*, 54*c*, 54*d*), in each rigid housing through holes (30*a*, 30*b*, 30*c*, 30*d*), respectively.

A power supply (24) can be connected to each light through a control module (42) which can communicate with a processor (44) with data storage (46) containing computer instructions (48) for animating the light array connected to the light array via a network (50).

In an embodiment, the control module can be connected to the lights for providing an animated light display. The control module can communicate with a processor with data storage containing computer instructions for animating the light array connected to the light array via the network. Which is shown in more detail, in FIG. 1.

Figure 2:
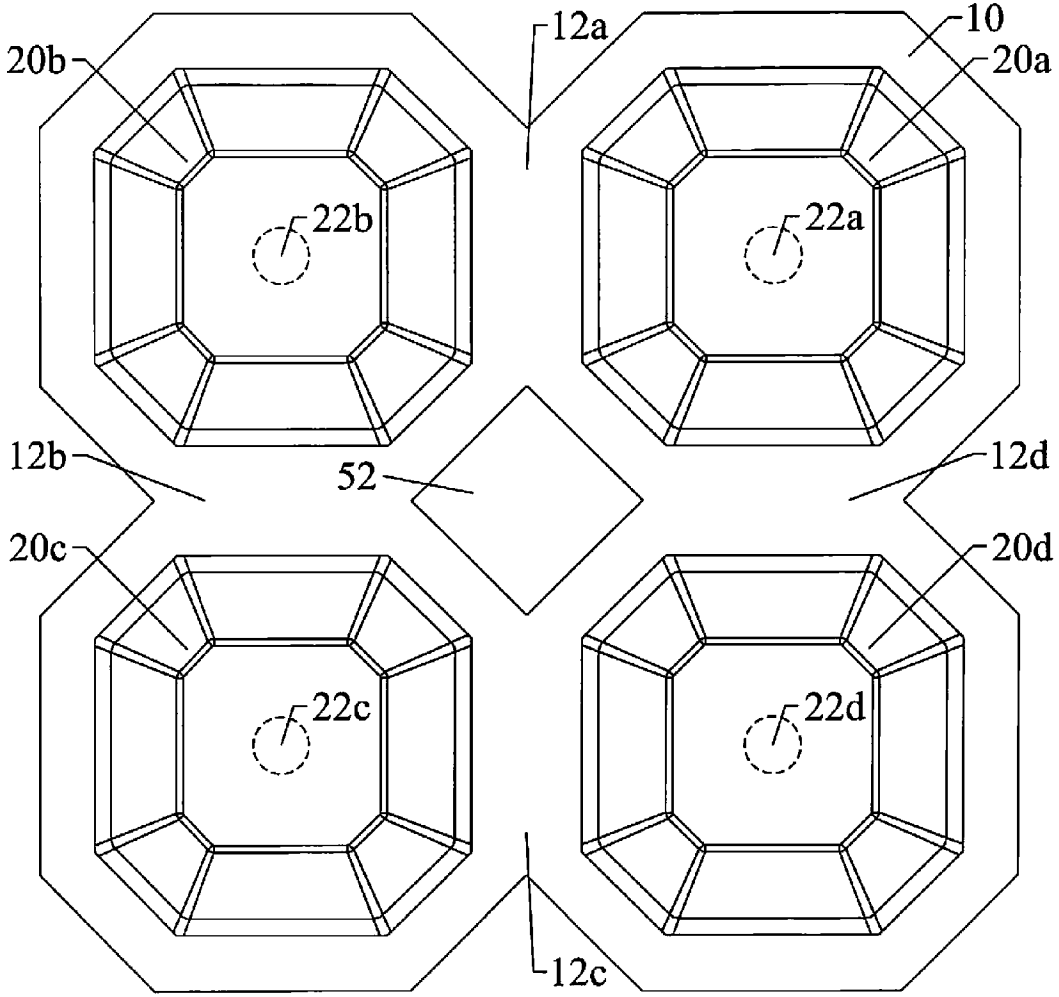
FIG. 2 depicts a top, or front, view of the lighting array according to the embodiments.

FIG. 2 depicts a top, or front, view of the lighting array according to the embodiments. The array can comprise a grid (10) adapted to be formed into multiple positions.

At least one interconnected wall (12*a*, 12*b*, 12*c*, 12*d*) can be between each pair of cells, and a rigid housing (20*a*, 20*b*, 20*c*, 20*d*) can be removably, or unremovably, insertable into each cell.

At least one light (22*a*, 22*b*, 22*c*, 22*d*) can be supported, or non-supported, within each rigid housing.

A wind hole (52) can be formed between cells for providing stability to the array under exterior environmental conditions.

Figure 3:
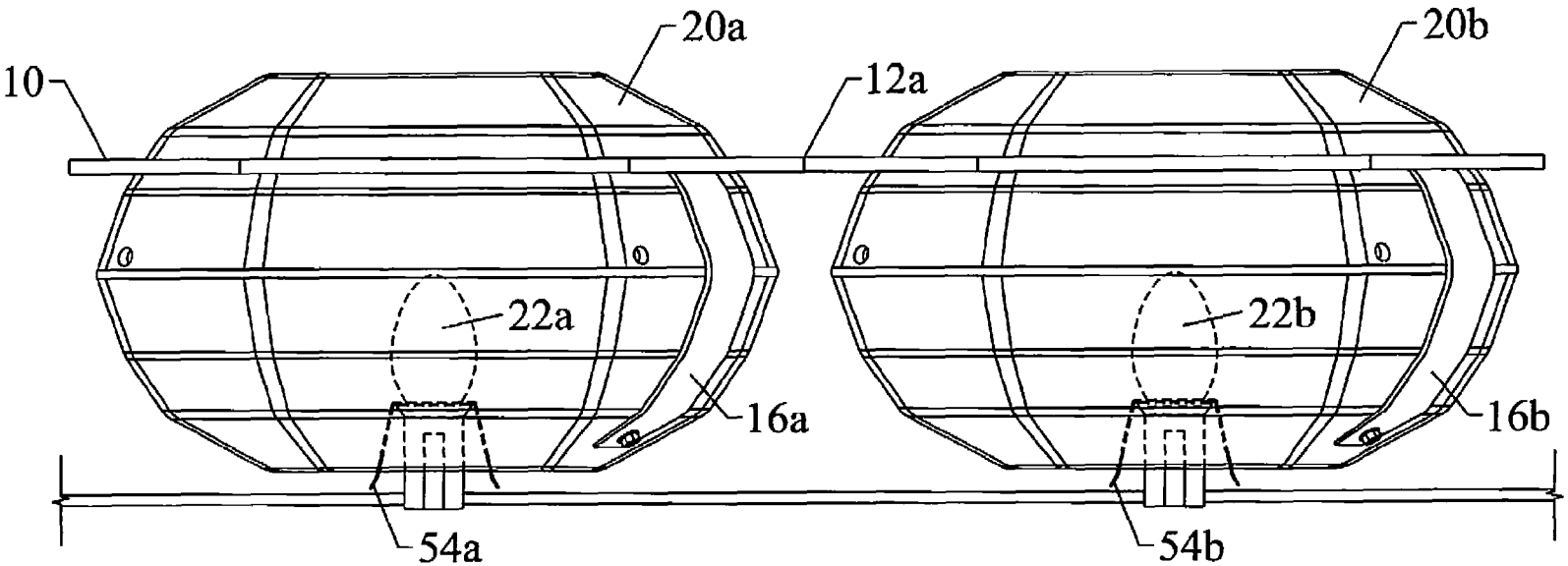
FIG. 3 depicts a side, or 90 degree, view of the lighting array according to the embodiments.

FIG. 3 depicts a side, or 90 degree, view of the lighting array according to the embodiments. The array can comprise a grid (10) adapted to be formed into multiple positions.

An interconnected wall (12*a*) can be between each pair of cells, and a holding arm (16*a* and 16*b*) can be secured to each cell.

A rigid housing (20*a*, 20*b*) can be removably, or unremovably, insertable into each cell and held in place by the holding arms (16*a* and 16*b*).

At least one light (22*a*, 22*b*) can be supported within each rigid housing. Wherein a lightweight clip (54*a*, 54*b*) holds the light in the rigid housing.

Figure 4:
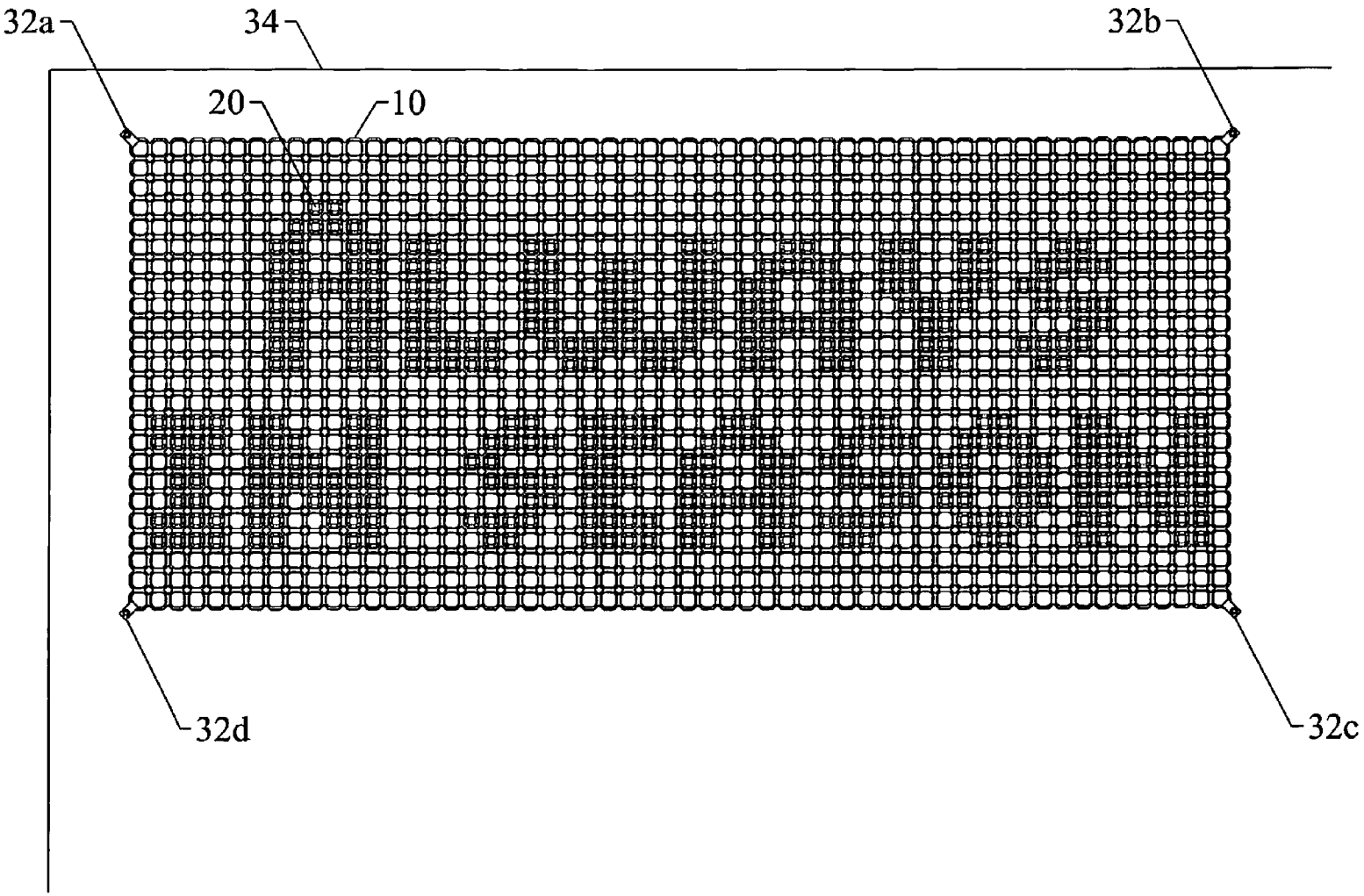
FIG. 4 depicts a view of the invention without lights for use as a marketing sign on a facility advertising or promoting a business.

FIG. 4 depicts an embodiment of the invention without lights for use as a marketing sign advertising or promoting a business. The array can comprise a grid (10) and at least one fastener (32*a*, 32*b*, 32*c*, 32*d*) for securing the array to a facility (34), which can provide a day time effect.

A plurality of rigid housings (20) can be secured to the grid (10) in a manner that can be used to create a written message or other design.

Figure 5:
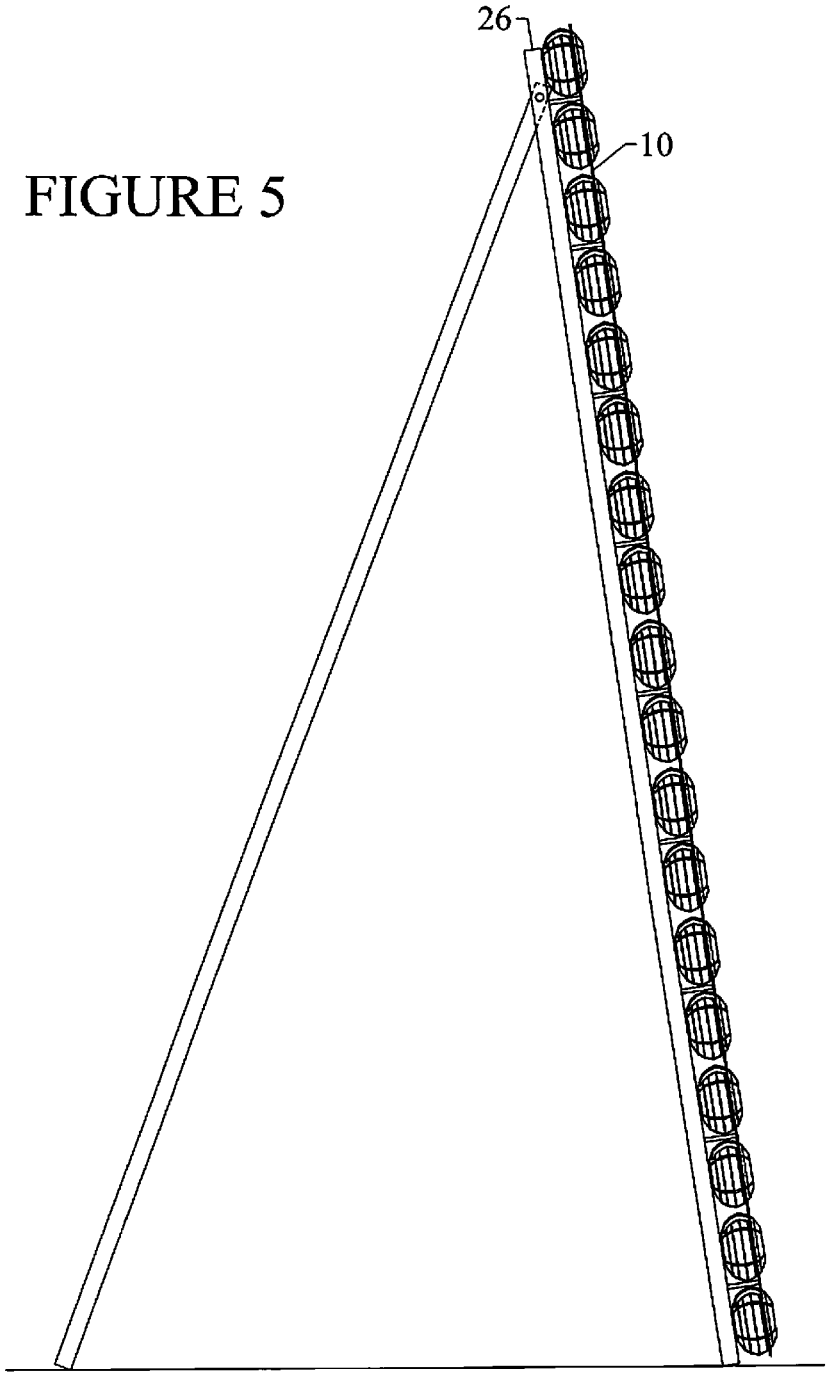
FIG. 5 depicts a grid on a frame in an embodiment.

FIG. 5 shows the grid (10) on a frame (26), according to an embodiment of the invention.

Figure 6:
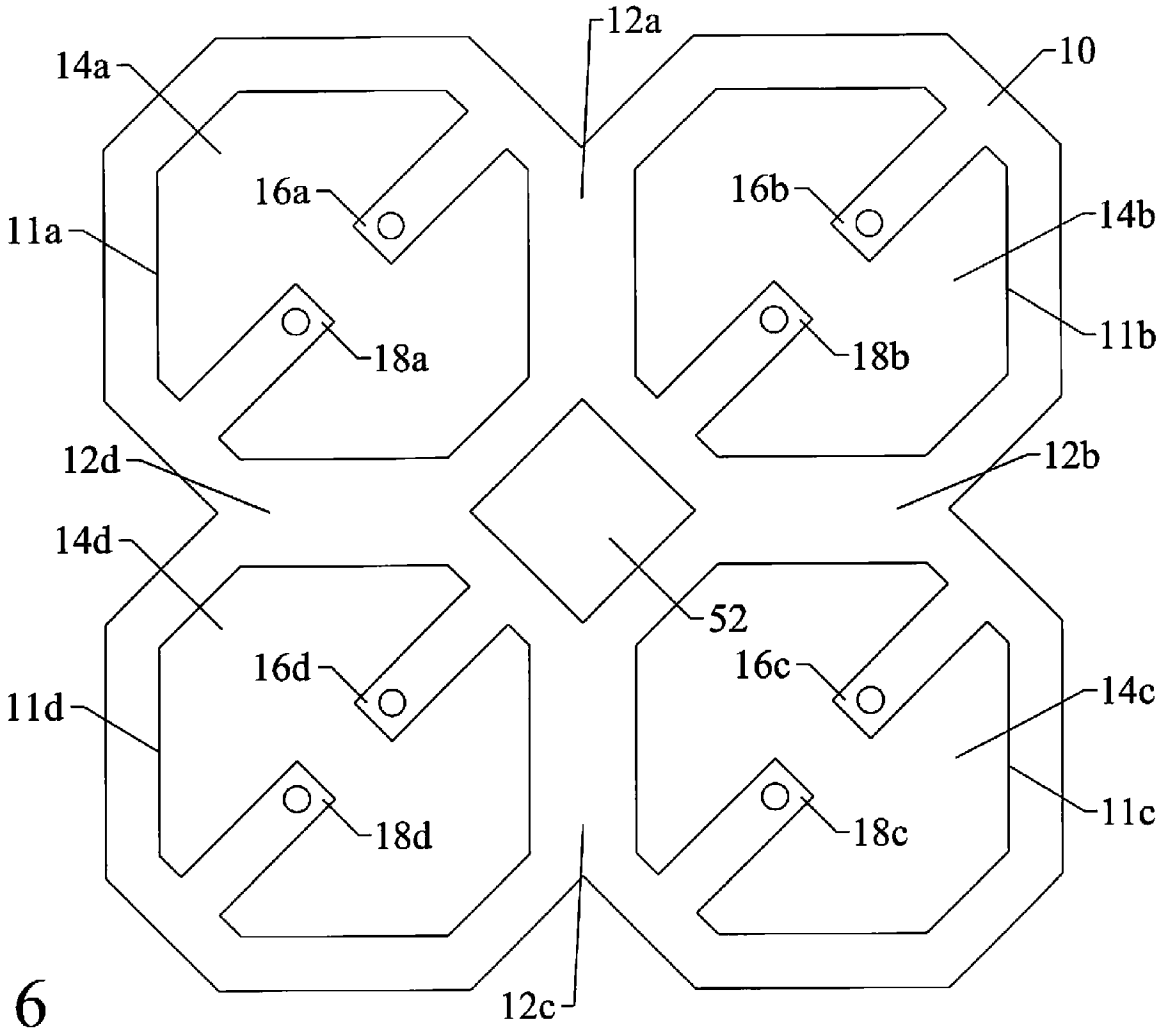
FIG. 6 depicts the grid of a non lit array.

FIG. 6 depicts the grid of a non lit array. The array can comprise a grid (10) adapted to be formed into multiple positions comprising at least two cells (11*a*, 11*b*, 11*c*,11*d*).

At least one interconnected wall (12*a*, 12*b*, 12*c*, 12*d*) can be between each pair of cells, and an opening (14*a*, 14*b*, 14*c*, 14*d*) can be formed in each cell.

A first holding arm (16*a*, 16*b*, 16*c*, 16*d*) can be secured to each cell, and a second holding arm (18*a*, 18*b*, 18*c*, 18*d*) can be secured to each cell opposite the first holding arm.

A wind hole (52) can be formed between cells for providing stability to the array under exterior environmental conditions.

Figure 7:
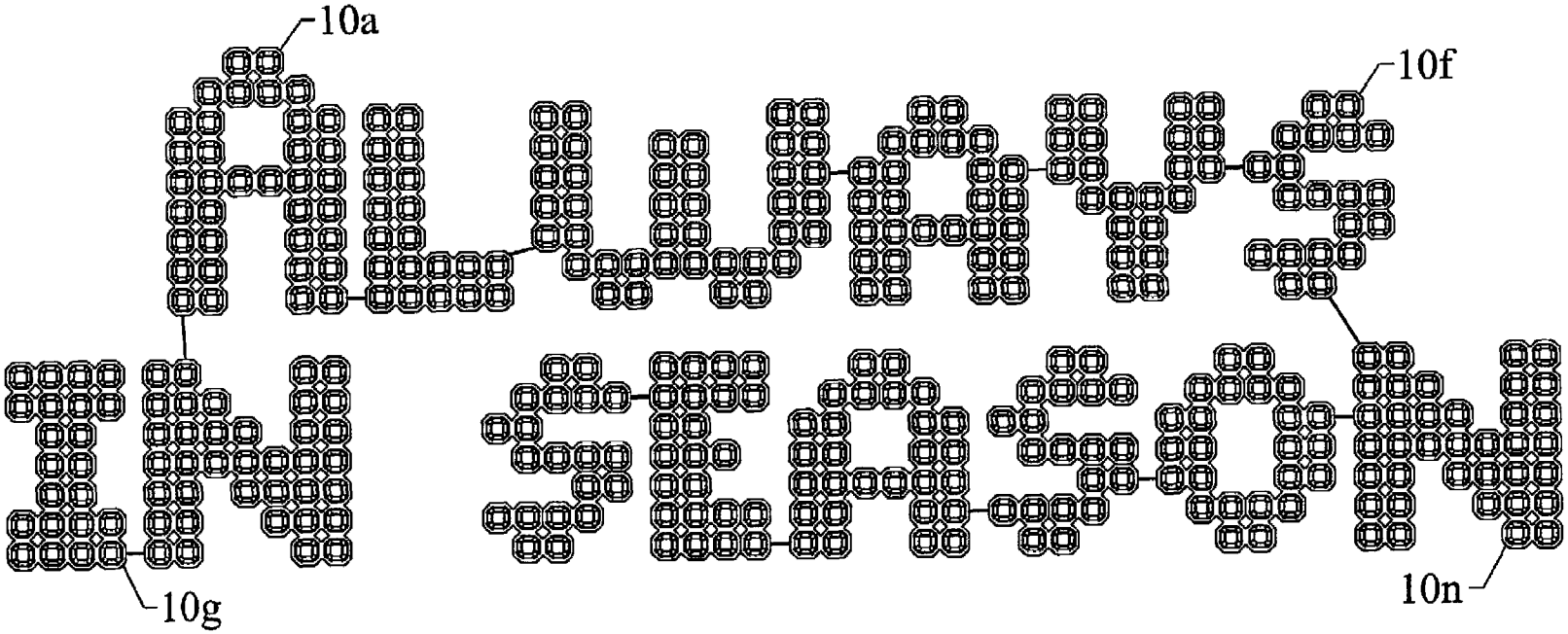
FIG. 7 depicts a group of interconnected grids for forming a large multipart marketing display advertising a business.

FIG. 7 shows a group of interconnected grids (10*a*-10*n*) for forming a large multipart marketing display advertising a business.

Figure 8B:
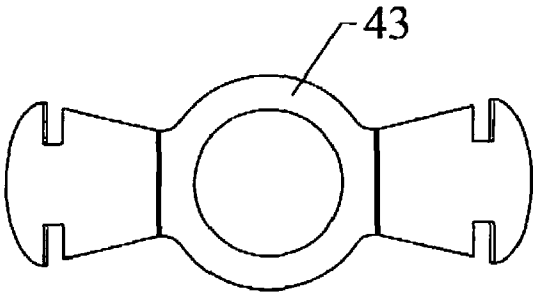
FIG. 8B shows a top view of the lightweight clip.
Figure 8A:
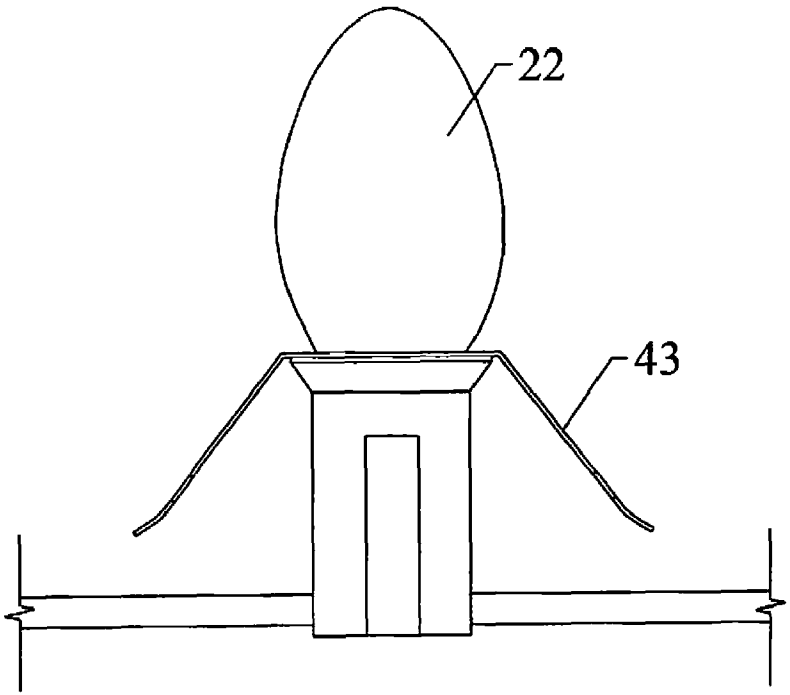
FIG. 8A shows a light together with the lightweight clip which is part of an embodiment of the invention.

FIGS. 8A and 8B show a lightweight clip (43) which is used to support the light (22).

While these embodiments have been described with emphasis on the embodiments, it should be understood that within the scope of the appended claims, the embodiments might be practiced other than as specifically described herein.

What is claimed is:

1. A lighting array comprising:

a. a grid adapted to be formed into multiple positions, comprising:
   (i) at least two cells;
   (ii) at least one interconnected wall between each pair of cell; and
   (iii) an opening in each cell forming a through hole there through;

b. at least a first holding arm secured to each cell;

c. a second holding arm secured to each cell opposite the first holding arm;

d. a rigid housing removably insertable into the opening of each cell, wherein the rigid housing at least partially protrudes out of the opening;

e. at least one light supported within each rigid housing; and f. a power supply connected to each light.

2. The lighting array of claim 1, wherein the grid comprises rearrangable housings or a malleable bendable non-degradable coatable grid backing.

3. The lighting array of claim 1, wherein the grid backing is rigid.

4. The lighting array of claim 1, wherein the grid can be coatable with a paint, or a UV resistant coating, or another material that inhibits degradation in the elements or adds a decorative element.

5. The lighting array of claim 1, wherein the grid is formed from a malleable material.

6. The lighting array of claim 1, wherein the lighting array is recyclable.

7. The array of claim 1, wherein the grid consists of a bendable member of the group comprising: a flexible metal, an elastic polymer, a composite disposed over a metal or combinations therein.

8. The array of claim 1 further comprising a frame for supporting the grid.

9. The array of claim 8, wherein the grid is in the shape of an object selected from the group consisting of: a Christmas tree, an ornament, a Santa Claus, a reindeer, a sleigh, a candy cane, an elf, a gift box, a star, a snowflake, a train, a caboose, a train car, a race car, a flower, or combinations thereof.

10. The array of claim 1, wherein the rigid housing is a hollow plastic jewel with a hole disposed in each jewel for supporting at least one light in each cell.

11. The array of claim 1, wherein the rigid housing is a three dimensional shape.

12. The array of claim 1, wherein the at least one light is a colored light, a clear light, or combinations thereof.

13. The array of claim 10, wherein the jewel is a colored plastic, a clear plastic, a painted plastic, glittered plastic or combinations thereof.

14. The array of claim 13, wherein the at least one light is colored to match the color of the hollow plastic jewel.

15. The array of claim 1, further comprising at least one fastener for securing the lighting array to a facility.

16. The array of claim 1, further comprising a control module connected to the lights for providing an animated light display.

17. The array of claim 16, wherein the control module communicates with a processor with data storage containing computer instructions for animating the light array connected to the light array via a network.

18. The array of claim 1, further comprising at least one wind hole formed between cells for providing stability to the array if in any environment.

19. The array of claim 1, wherein a lightweight clip holds the light into the rigid housing.

20. A customer attraction modular lighting array comprising:

a. plurality of interconnected grid, wherein each grid backing is a malleable bendable, non-degradable coatable grid backing comprising:
   (i) a plurality of cells;
   (ii) an interconnected wall between each pair of cells; and
   (iii) an opening in each cell;

b. at least a first holding arm secured to each cell;

c. a second holding arm secured to each cell opposite the first holding arm;

d. a rigid housing removably inserted in each cell;

e. at least one light supported by each rigid housing; and f. a power supply connected to each light in each interconnected grid backing, forming a modular lighting array as a sparkly customer attraction device, and wherein the interconnected grid backings can be bent into multiple positions, and then reformed into different positions for constant reuse.

21. The array of claim 20, wherein the grid is coated with glitter.

22. A lighting array comprising:

a. a grid adapted to be formed into multiple positions, the grid comprising:
   (i) at least two cells;
   (ii) at least one interconnected wall between each pair of cells; and
   (iii) an opening in each cell forming a through hole there through; and b. a rigid housing removably insertable into the opening of each cell, wherein the rigid housing at least partially protrudes out of the opening.

* * * * *